US005215873A

United States Patent [19]

Kiesslich et al.

[11] Patent Number: 5,215,873

[45] Date of Patent: Jun. 1, 1993

[54] PROCESS FOR DEVELOPING SILVER HALIDE RECORDING MATERIALS

[75] Inventors: Günter Kiesslich, Dieetzenbach; Max E. G. Wadewitz, Rosbach, both of Fed. Rep. of Germany

[73] Assignee: E. I. Du Pont de Nemours and Company, Wilmington, Del.

[21] Appl. No.: 870,209

[22] Filed: Apr. 13, 1992

Related U.S. Application Data

[63] Continuation of Ser. No. 606,086, Oct. 30, 1990, abandoned.

[30] Foreign Application Priority Data

Nov. 21, 1989 [DE] Fed. Rep. of Germany ..... 3938573

[51] Int. Cl.[5] ..... G03C 5/24

[52] U.S. Cl. ..... 430/448; 430/435; 430/438; 430/464; 430/481; 430/493; 430/966

[58] Field of Search ..... 430/309, 399, 434, 435, 430/438, 448, 464, 481, 485, 486, 490, 493, 966

[56] References Cited

U.S. PATENT DOCUMENTS

| | | | |
|---|---|---|---|
| 2,000,353 | 5/1935 | Schaeffer | 95/88 |
| 2,533,990 | 12/1950 | Blake | 430/493 |
| 2,950,970 | 8/1960 | Schwan et al. | 430/493 |
| 3,157,502 | 11/1964 | Jonker et al. | 430/493 |
| 3,167,429 | 1/1965 | Levy | 430/481 |
| 3,251,692 | 5/1966 | Jonker et al. | 430/493 |
| 3,272,628 | 9/1966 | Connolly et al. | 96/66 |
| 3,390,998 | 7/1968 | Cole | 430/493 |
| 3,622,330 | 11/1971 | Valiaveedan | 96/66 |
| 3,754,924 | 8/1973 | De Geest et al. | 96/114.2 |
| 3,819,378 | 6/1974 | Speers | 430/481 |
| 4,839,273 | 6/1989 | Yamada et al. | 430/464 |

FOREIGN PATENT DOCUMENTS

| | | | |
|---|---|---|---|
| 0223883 | 6/1987 | European Pat. Off. | 430/493 |

*Primary Examiner*—Hoa Van Le

[57] ABSTRACT

Process for developing photographic silver halide recording elements containing nonionic fluorinated surfactants using a developer containing at least 15 g/L of dihydroxy benzene compound, 0.15 mole/L of alkali metal sulfate and a wetting agent as described in a concentration of at least 0.1 g/L at a pH of no greater than 11.5. Silver halide recording elements that can be developed are those particularly useful in medical diagnostics with X-rays and in reprography.

2 Claims, No Drawings

PROCESS FOR DEVELOPING SILVER HALIDE RECORDING MATERIALS

This is a continuation of application Ser. No. 07/606,086 filed Oct. 30, 1990, now abandoned.

This invention relates to a process for developing photographic silver halide recording elements, particularly for use in x-ray diagnostics and reprography.

DeGeest U.S. Pat. No. 3,754,924 discloses the preparation of photographic silver halide recording elements by coating flexible supports with light-sensitive silver halide emulsions and outer coatings containing nonionic fluorinated surfactants. The resulting elements have an array of advantageous characteristics, for example, a low tendency for electrostatic accumulation.

If such elements, however, are developed with the aid of a roll development machine, the recorded image is marred by the occurrence of light spots. These spots appear in various shapes and sizes, irregularly spaced. They are extremely bothersome, because, for example, they can lead to mistakes in x-ray diagnostics. Their appearance is observed especially with the use of concentrated developers containing more than 15 g/L of a dihydroxy benzene developer, for example, hydroquinone, and more than 0.15 mole/L of an alkali metal sulfite, at a pH no greater than 11.5. Such developers are preferred for use in roll development machines, because of their stability, activity, and efficiency (see, for example, L. F. A. Mason, "Processing Chemistry", Focal Press, London and New York 1966, page 151, Table).

It has been found that the above problem can be overcome by developing photographic silver halide recording elements containing nonionic, fluorinated surfactants using a developer containing at least 15 g/L of a dihydroxy benzene compound and at least 0.15 mole/L of an alkali metal sulfate and a wetting agent as described below.

In accordance with this invention there is provided a process for the development of a photographic silver halide recording element comprising a support bearing at least one layer of a silver halide emulsion, the element containing a nonionic, fluorinated surfactant, the silver halide recording element being developed by treating with a developer containing at least 15 g/L of a dihydroxy benzene compound, at least 0.15 mole/L of an alkali metal sulfite, and a wetting agent in a concentration of at least 0.1 g/L at a pH no greater than 11.5. A preferred pH range is between 9 and 11.5.

The wetting agent in the developer should be selected so that it is clearly soluble in the developer at a concentration of at least 0.1 g/L. Wetting agents that are merely dispersed are not suitable, because they promote the formation of sludge and can lead to contamination of the developed elements. Fundamentally, there is no upper concentration limit; for practical reasons (foam formation, costs), 10 g/L should not be exceeded. A preferred concentration range for the wetting agent is 0.5 g/L or greater.

Anionic wetting agents are preferred for performing the process of the invention. These are generally more easily soluble in weakly alkaline developer solution than cationic or nonionic wetting agents. In addition, they generally affect photographic results less than cationic wetting agents.

The following wetting agents have proved to be particularly good in the operation of the process:

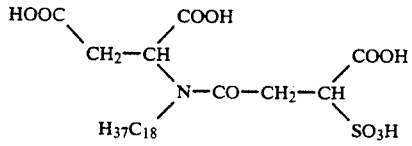

(I,1)

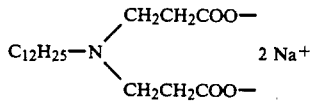

(I,2)

a mixture of

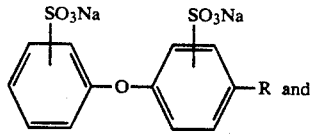

(I,3)

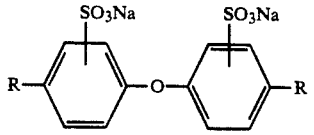

wherein R is $\alpha$-$C_{10}$ alkenyl (trademark "Dowfax" 3B2, Dow Chemical (Nederland) B. V., Botlek, The Netherlands).

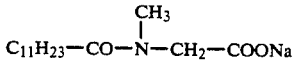

(I,4)

The concentration of the wetting agent in the developer solution generally decreases more or less rapidly during use because of developer replenishment and because some is removed by occlusion on the silver halide elements being processed. This applies particularly in the case of low starting concentrations. Therefore, it can be advantageous to inject an aqueous solution of the wetting agent into the development tank or the developer replenishment line depending on material throughput, in order to maintain a uniform low concentration.

The silver halide recording element can contain any of the silver halide emulsion layers known to those skilled in the art, particularly those useful with X-rays. A protective layer of a hydrophilic colloid, e.g., gelatin, is preferably present as an outer layer for the element. While gelatin is the preferred hydrophilic colloid material other hydrophilic colloidal materials or mixtures of them, e.g., hydrophilic natural colloids, modified hydrophilic natural colloids or synthetic hydrophilic polymers may also be used. More particularly these colloids may be selected of such film-forming natural or modified natural hydrophilic colloids as, e.g., glue, casein, zein, hydroxyethyl cellulose, carboxymethyl cellulose, methyl cellulose, carboxymethyl hydroxyethyl cellulose, gum arabic, sodium alginate and hydrophilic derivatives of such colloids. They may also be selected of such synthetic hydrophilic polymers as, e.g,. polyvinyl alcohol, poly-N-vinyl pyrrolidone, polyvinyl amine, polyethylene oxide, polystyrene sulphonic acid, polyacrylic acid, and hydrophilic copolymer sand derivatives of such polymers.

Fluorinated, nonionic surfactants within the scope of the invention useful in the photographic silver halide recording elements have molecules that are composed preferably of a polyalkylene oxide portion and a partially or wholly fluorinated alkyl or aryl portion, connected by a bridge, for example, an ether or sulfone carbamide bridge. Examples of such surfactants are:

$F(CF_2CF_2)_m—CH_2CH_2—O—(CH_2CH_2—O—)_{11}H$, (II,1)
with m = 2 to 8 (Trademark "Zonyl" FSN, E. I. du Pont de Nemours & Co., Wilmington, DE)

$F(CF_2)_n—(CH_2CH_2—O—)_mH$, (II,2)
with n = 6, 8 or 10 and m = 6 to 12 (Trademark "Lodyne" S 107, Ciba-Geigy Corp., Ardsley, NY)

$C_8F_{17}—SO_2—N(CH_3)—CO—O—(CH_2CH_2—O)_{19}C_4H_9$ (II,3)
(Trademark FT 219, Bayer AG, Leverkusen, Germany)

Other known fluorinated, nonionic surfactants are useful, preferably present in a hydrophilic colloid, e.g., gelatin, protective layer in an amount of about 1 to 125 mg/m$^2$.

By means of the process of the invention, it is possible to make unlimited use of the advantageous effects of nonionic, fluorinated surfactants on the properties of silver halide materials.

The process of the invention can be used for photographic silver halide recording materials, particularly in medical diagnostics with x-rays and in reprography.

The following example illustrates but does not limit the invention.

EXAMPLE

A silver iodobromide emulsion with crystals of 0.4 $\mu m^3$ average grain volume and 2 mole percent iodide content was coated on both sides of a polyethylene terephthalate support. The emulsion contained 100 g gelatin per mole silver, the usual additives for chemical sensitization and stabilization, and the usual coating aids. The silver coating weight on each side was 2.6 g/m$^2$. A protective gelatin layer was applied at a coating weight of 1.3 g/m$^2$ on the emulsion layer on both sides. In addition, the protective layer contained a nonionic, fluorinated surfactant, as shown for the various, otherwise similar samples in the Table below.

Sheets, 35×43 cm, of the various test films were exposed so that their optical density after processing was between 1 and 2. The exposed sheets were processed in a roll developer machine for 90 seconds total processing time at 34° C. with a commercial fixing bath and one of the following developer formulas:

| | Developer | |
|---|---|---|
| | Formula A | Formula B |
| Hydroquinone (g/L) | 25.0 | 10 |
| Alkali disulfite (as mol/L $SO_3^{-2}$ | 0.22 | 0.10 |
| Benzotriazole (mg/L) | 95 | 95 |
| Phenyl pyrazolidinone (g/L) | 1.7 | 1.7 |
| Potassium bromide (g/L) | 6.0 | 6.0 |
| Potassium hydroxide (g/L) | 50.0 | 50.0 |
| Boric acid (g/L) | 10.5 | 10.5 |
| Glutardialdehyde, potassium bisulfite adduct (g/L) | 15.0 | 15.0 |
| Wetting agent, as shown in Table below | 10.3 | 10.3 |
| pH as adjusted with sodium hydroxide solution or sulfuric acid | | |

the developed film sheets were tested for the presence of white spots with the aid of a viewing light box. The results are shown in the Table below.

The solubility of the comparison wetting agents A, B, and C was below 0.1 g/L in the Formula A developer. The structural formulas of these compounds are:

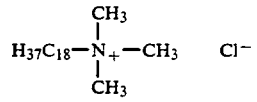
(A)

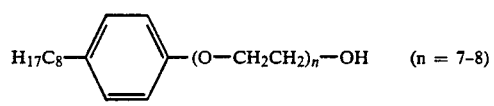
(B)

(C)

TABLE

| Test | Developer | Wetting Agent Type | Wetting Agent Quantity (g/L) | Fluorinated Compound Type | Quantity (mg/m$^2$) | White spots | Remarks |
|---|---|---|---|---|---|---|---|
| 1 | A | — | — | II-1 | 12.5 | Yes | Comparison |
| 2 | A | — | — | II-3 | 38.0 | Yes | Comparison |
| 3 | A | — | — | II-2 | 25.0 | Yes | Comparison |
| 4 | A | I-2 | 0.090 | II-1 | 12.5 | Yes | Comparison |
| 5 | A | I-2 | 0.125 | II-1 | 12.5 | No | Invention |
| 6 | A | I-2 | 2.0 | II-1 | 12.5 | No | Invention |
| 7 | A | I-2 | 0.125 | II-2 | 25.0 | No | Invention |
| 8 | A | I-3 | 0.125 | II-3 | 38.0 | No | Invention |
| 9 | A | I-1 | 0.9 | II-1 | 12.5 | No | Invention |
| 10 | A | A | saturated | II-1 | 12.5 | Yes | Comparison |
| 11 | A | B | saturated | II-1 | 12.5 | Yes | Comparison |
| 12 | A | C | saturated | II-1 | 12.5 | Yes | Comparison |
| 13 | B | — | — | II-1 | 12.5 | No | Comparison |

We claim:

1. A process for the chemical development of a photographic silver halide recording element comprising a support bearing at least one layer of a silver halide emulsion, the element containing a nonionic, fluorinated surfactant, the silver halide recording element being chemically developed by treating with a developer consisting essentially of at least 15 g/L of a dihydroxy benzene compound, at least 0.15 mole/L of an alkali metal sulfite, and an anionic wetting agent selected from the group consisting of the following formulas (I, 1), (I, 2), (I-3) and (I-4) in a concentration of at least 0.1 g/L at a pH no greater than 11.5

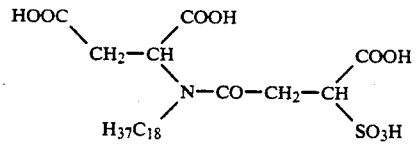

(I,1)

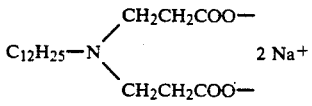

(I,2)

a mixture of

-continued

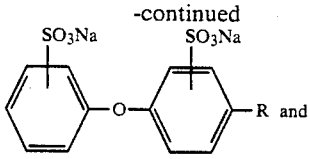

(I,3)

and

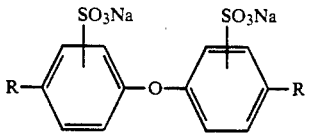

wherein R is alpha-$C_{10}$ alkenyl

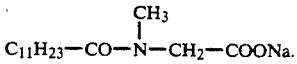

(I,4)

2. A process according to claim 1 wherein that the concentration of the wetting agent dissolved in the developer is at least 0.5 g/L.

* * * * *